US010150157B2

(12) United States Patent
Tsutsumi

(10) Patent No.: US 10,150,157 B2
(45) Date of Patent: Dec. 11, 2018

(54) BUOYANCY TRANSFER JIG

(71) Applicant: Kabushiki Kaisha Kobe Seiko Sho (Kobe Steel, Ltd.), Hyogo (JP)

(72) Inventor: Kazuyuki Tsutsumi, Kobe (JP)

(73) Assignee: Kobe Steel, Ltd., Hyogo (JP)

( * ) Notice: Subject to any disclaimer, the term of this patent is extended or adjusted under 35 U.S.C. 154(b) by 84 days.

(21) Appl. No.: 15/529,938

(22) PCT Filed: Nov. 10, 2015

(86) PCT No.: PCT/JP2015/081629
§ 371 (c)(1),
(2) Date: May 25, 2017

(87) PCT Pub. No.: WO2016/088517
PCT Pub. Date: Jun. 9, 2016

(65) Prior Publication Data

US 2017/0326624 A1 Nov. 16, 2017

(30) Foreign Application Priority Data

Dec. 3, 2014 (JP) ..... 2014-244630

(51) Int. Cl.
*B22C 21/14* (2006.01)
*B22C 7/02* (2006.01)
*B22C 9/04* (2006.01)

(52) U.S. Cl.
CPC ..... *B22C 21/14* (2013.01); *B22C 7/02* (2013.01); *B22C 9/04* (2013.01); *B22C 9/046* (2013.01)

(58) Field of Classification Search
CPC ..... B22C 21/14; B22C 7/02; B22C 7/023; B22C 9/04; B22C 9/046; B22C 9/10
See application file for complete search history.

(56) References Cited

U.S. PATENT DOCUMENTS 4,804,032 A * 2/1989 Wilkins ..... B22C 9/046 164/119
4,865,112 A * 9/1989 Schwarb ..... B22D 19/00 164/34

(Continued)

FOREIGN PATENT DOCUMENTS

JP S53-068620 A 6/1978
JP 2009-119469 A 6/2009
JP 2011-110577 A 6/2011

OTHER PUBLICATIONS

Notification Concerning Transmittal of International Preliminary Report on Patentability and Translation of Written Opinion of the International Searching Authority; PCT/JP2015/081629; dated Jun. 15, 2017.

(Continued)

*Primary Examiner* — Kevin E Yoon
(74) *Attorney, Agent, or Firm* — Studebaker & Brackett PC

(57) ABSTRACT

The buoyancy transfer jig includes: a rod-shaped rod portion which is disposed extending from an outside of a pattern to an inside of a hollow portion by way of an opening portion which is formed in a foamed mold and makes the outside of the pattern and the hollow portion connected with each other, and is disposed in self hardening sand filled in the hollow portion and the opening portion; and a plate-shaped blade portion which is formed continuously with the rod portion and is disposed in the casting sand.

4 Claims, 6 Drawing Sheets

(56) References Cited

U.S. PATENT DOCUMENTS 5,524,696 A * 6/1996 Osborne ..... B22C 9/046
164/120
2012/0273151 A1 11/2012 Hirai et al.

OTHER PUBLICATIONS

International Search Report issued in PCT/JP2015/081629; dated Feb. 2, 2016.

* cited by examiner

BUOYANCY TRANSFER JIG

CROSS-REFERENCE TO RELATED APPLICATIONS

This is a national phase application in the United States of International Patent application No. PCT/JP2015/081629 with an international filing date of Nov. 10, 2015, which claims priority of Japanese Patent Application No. 2014-244630 filed on Dec. 3, 2014. The contents of this application are incorporated herein by reference.

TECHNICAL FIELD

The present invention relates to a buoyancy transfer jig used in a lost foam casting method by which a cast product is produced by casting.

BACKGROUND ART

Besides a general method by which a cast product is produced by sand mold casting, there has been proposed a method by which a cast product having excellent size accuracy is produced by casting. For example, an investment casting method (also referred to as a lost wax method), a plaster pattern casting method, a lost foam casting method and the like have been developed.

The lost foam casting method is a method for casting a cast product where a pattern is prepared by applying a refractory coating by coating to a surface of a foamed mold, the pattern is embedded into casting sand and, thereafter, molten metal is poured into the inside of the pattern, and the foamed mold is replaced with the molten metal by burning out the foamed mold.

JP 2011-110577 A discloses a lost foam casting method where a casting time at the time of casting is set corresponding to a modulus of the mold (a volume of the mold÷a surface area of the mold).

SUMMARY OF THE INVENTION

Problems to be Solved by the Invention

In producing a cast product having an inner space by a cavity casting method used in general, as shown in FIG. 10 which is a cross-sectional side view, a sand mold referred to as a core 24 having a shape which corresponds to a shape of an inner space of a cast product is disposed in the inside of a hollow space 23 formed between an upper mold 21 and a lower mold 22. However, as shown in FIG. 11 which is a cross-sectional side view, during casting, the core 24 is surrounded by molten metal and receives buoyancy in a vertical direction. Accordingly, unless a support portion for supporting the core 24 is provided, the core 24 floats. When the core 24 floats, the cast product where the position of the inner space is displaced is produced.

In view of the above, as shown in FIG. 12 which is a cross-sectional side view, surplus portions 25 referred to as baseboards which project in a horizontal direction are formed on the core 24, and the core 24 is supported by the upper mold 21 and the lower mold 22 by way of the surplus portions 25 thus preventing floating of the core 24.

On the other hand, in case of a lost foam casting method, a shape of the inner space is formed by filling the foamed mold with the casting sand. In this case, however, it is difficult to support the casting sand filled in the inside of the foamed mold by forming baseboards on portions other than a product. Accordingly, during casting, "floating" occurs where casting sand filled in the inside of the foamed mold is surrounded by the molten metal, and floats by receiving buoyancy in the vertical direction.

In view of the above, as shown in FIG. 13 which is a cross-sectional side view, a large opening portion 17 which makes the outside of the foamed mold 12 surrounded by the casting sand 15 and the inside of the foamed mold connected with each other is formed on an upper portion of the foamed mold 12 so that a stacked load equal to or greater than buoyancy is applied to the casting sand 16 filled in the inside of the foamed mold 12. With such a configuration, floating of the casting sand 16 filled in the inside of the foamed mold 12 is prevented. However, when a restriction is imposed on a shape of a cast product to be produced by casting, the large opening portion 17 cannot be formed on the foamed mold 12 so that a lost foam casting method cannot be adopted.

It is an object of the present invention to provide a buoyancy transfer jig capable of producing by casting a cast product having a favorable finished state by suppressing floating of casting sand filled in the inside of the foamed mold.

Solutions to the Problems

The present invention is directed to a buoyancy transfer jig used in a lost foam casting method for casting a cast product where a pattern is prepared by applying a refractory coating by coating to a surface of a foamed mold having a hollow portion in the inside thereof, the pattern is embedded into casting sand and, thereafter, molten metal is poured into the inside of the pattern, and the foamed mold is replaced with the molten metal by burning out the foamed mold, wherein the buoyancy transfer jig includes: a rod-shaped rod portion which is disposed extending from an outside of the pattern to an inside of the hollow portion by way of an opening portion which is formed in the foamed mold and makes the outside of the pattern and the hollow portion connected with each other, and is disposed in self hardening sand filled in the hollow portion and the opening portion; and a plate-shaped blade portion which is formed continuously with the rod portion and is disposed in the casting sand.

Effects of the Invention

According to the present invention, by disposing the rod portion in the self hardening sand filled in the hollow portion and the opening portion, buoyancy which acts on the sand in the hollow portion is transferred to the rod portion. Further, by disposing the blade portion which is formed continuously with the rod portion in the casting sand disposed outside the pattern, the buoyancy transferred to the blade portion from the rod portion is received by the casting sand disposed outside the pattern. With such an operation, a reaction force (resistance force) which resists against buoyancy can be generated in the self hardening sand filled in the opening portion. Accordingly, it is possible to suppress floating of self hardening sand filled in the inside of the foamed mold and hence, deformation of self hardening sand filled in the opening portion can be suppressed. As a result, it is possible to prevent the refractory coating applied to the opening portion by coating from being damaged and hence, it is possible to produce by casting a cast product having a favorable finished state.

EMBODIMENTS OF THE INVENTION

Hereinafter, a preferred embodiment of the present invention is described with reference to drawings.

(Lost Foam Casting Method)

A buoyancy transfer jig according to an embodiment of the present invention is used in a lost foam casting method. The lost foam casting method is a method for casting a cast product where a pattern is prepared by applying a refractory coating by coating to a surface of a foamed mold, the pattern is embedded into the casting sand (dry sand) and, thereafter, molten metal is poured into the inside of the pattern, and the foamed mold is replaced with the molten metal by burning out the foamed mold.

The lost foam casting method includes: a melting step where metal (cast iron) is melted thus producing molten metal; a forming step where a foamed mold is formed by molding; and a coating step where a refractory coating is applied by coating to a surface of the foamed mold thus producing a pattern. The lost foam casting method also includes: a mold forming step where the mold is embedded in casting sand and the casting sand is filled in all corners of the pattern; and a casting step where molten metal (metal in a molten state) is poured into the pattern so as to melt the foamed mold thus replacing the foamed mold with the molten metal. The lost foam casting method further includes: a cooling step where the molten metal poured into the pattern is cooled thus producing a cast product; and a separating step where the cast product and the casting sand are separated from each other.

As metal to be melted to produce molten metal, gray cast iron (JIS-FC250), spheroidal graphite cast iron (JIS-FCD450) or the like may be used. As a material for forming the foamed mold, a foamed resin such as styrene foam can be used. As a refractory coating, a refractory coating containing a silica-based aggregate or the like may be used. As casting sand, "silica sand" which contains $SiO_2$ as a main component, zircon sand, chromite sand, synthetic ceramic sand or the like may be used. An adhesive agent or a hardening agent may be added to the casting sand.

A thickness of the refractory coating is preferably set to 3 mm or less. This is because when the thickness of the refractory coating is set to 3 mm or more, it is necessary to repeatedly perform applying by coating and drying of the refractory coating three or more times and hence, such an operation takes time and efforts, and a thickness of the refractory coating is liable to become non-uniform.

Figure 1:
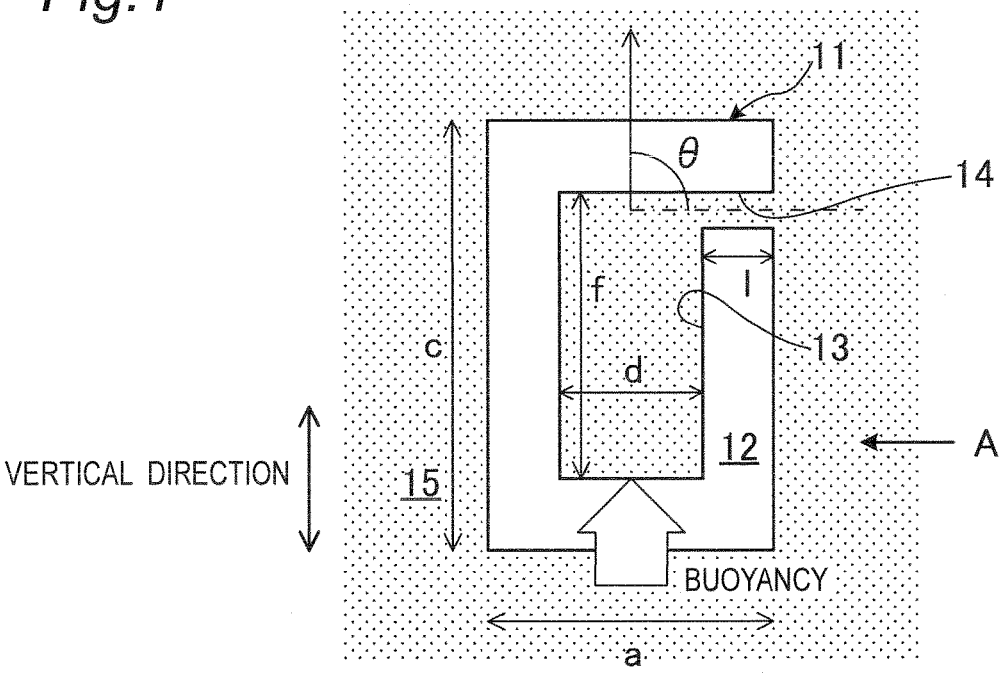
FIG. 1 is a cross-sectional side view of a pattern.
Figure 2:
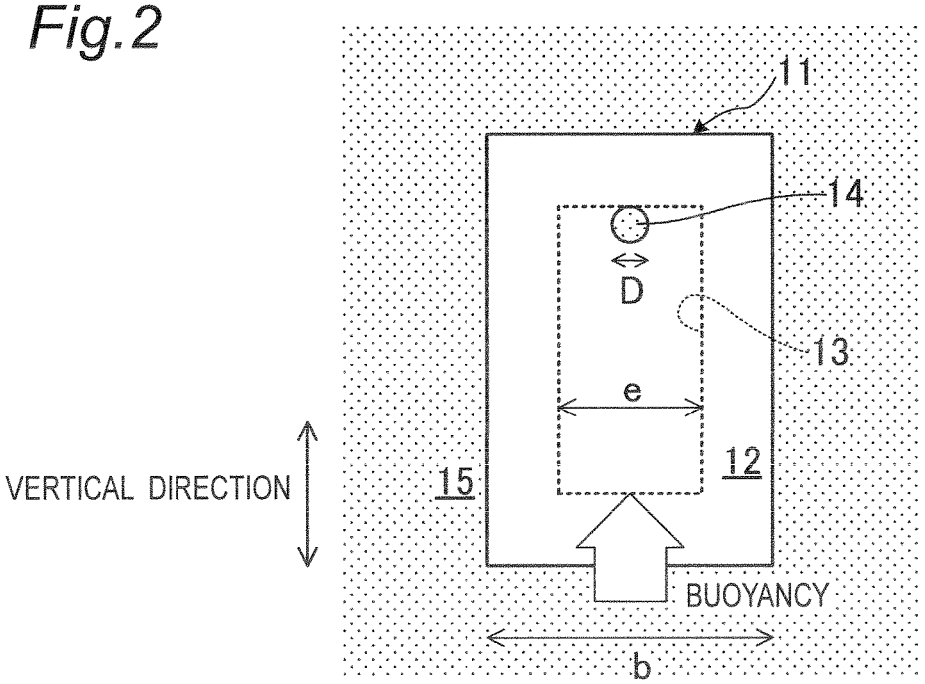
FIG. 2 is a side view of FIG. 1 as viewed in a direction A.

In this embodiment, as shown in FIG. 1 which is a cross-sectional side view of the pattern and FIG. 2 which is a side view of FIG. 1 as viewed in a direction A, a hollow portion 13 is formed in the inside of a rectangular parallelepiped foamed mold 12. That is, in this embodiment, a cast product having an inner space is produced by casting. An opening portion 14 which makes the outside of the pattern 11 and the hollow portion 13 connected with each other is formed in the foamed mold 12 such that the opening portion 14 penetrates the foamed mold 12 in the horizontal direction. In this embodiment, the foamed mold 12 has a width of a (mm), a depth of b (mm), and a height of c (mm). The hollow portion 13 has a width of d (mm), a depth of e (mm), and a height off (mm). The opening portion 14 has a diameter of D (mm) and a length of l (mm). Hardening sand is filled in the hollow portion 13 and the opening portion 14. Around the pattern 11 is covered by casting sand 15. A shape of the foamed mold 12 is not limited to a rectangular parallelepiped shape. The opening portion 14 is not limited to the configuration where the opening portion 14 extends in the horizontal direction. The opening portion 14 may extend in the vertical direction or may extend in the direction inclined with respect to the vertical direction.

(Buoyancy Transfer Jig)

Figure 3:
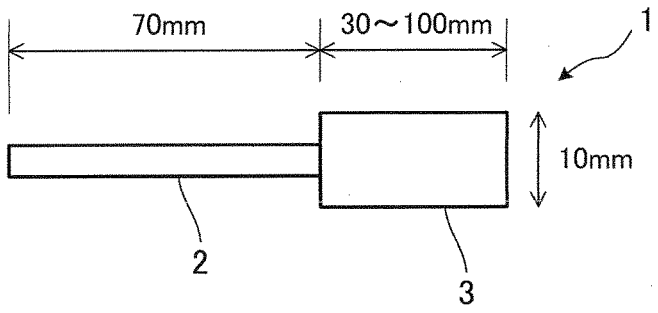
FIG. 3 is a side view of a buoyancy transfer jig.

A buoyancy transfer jig 1 according to this embodiment includes, as shown in FIG. 3 which is a side view, a rod-shaped rod portion 2, and a plate-shaped blade portion 3 which is formed continuously with the rod portion 2. The rod portion 2 is formed to have a rectangular cross-sectional shape, and a length of one side of a cross section is set larger than 3 mm. A length of the rod portion 2 in the axial direction is set to 70 mm, for example. However, the length of the rod portion 2 is not limited to such a length. A size of the blade portion 3 is set to 30 to 100 (mm)×10 (mm)×2 (mm), for example. However, the size of the blade portion 3 is not limited to such a size.

Figure 4:
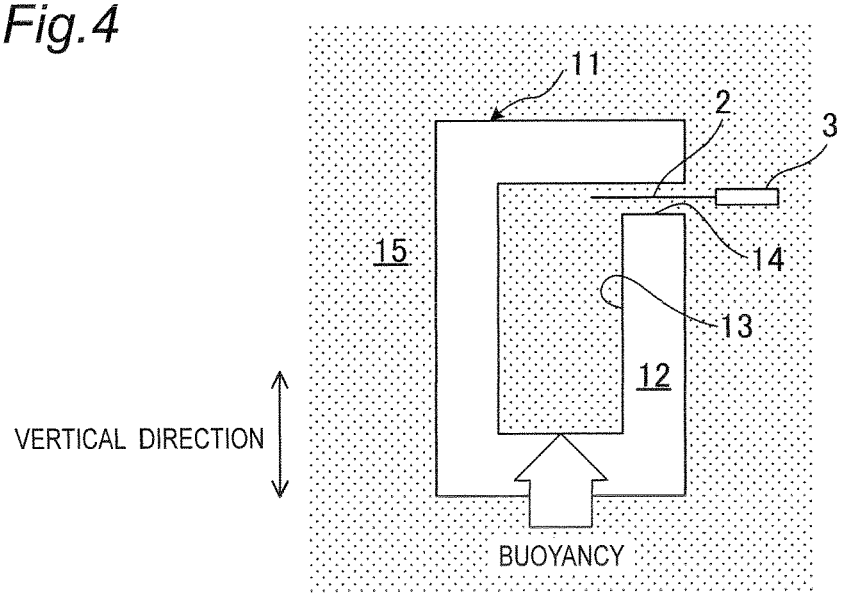
FIG. 4 is a cross-sectional side view of the pattern.

The rod portion 2 of the buoyancy transfer jig 1 is, as shown in FIG. 4 which is a cross-sectional side view of the pattern, inserted in the opening portion 14 before the self hardening sand is completely hardened. The rod portion 2 is disposed extending from an outside of the pattern 11 to an inside of the hollow portion 13 by way of the opening portion 14, and is disposed in self hardening sand filled in the hollow portion 13 and the opening portion 14. At this stage of operation, the blade portion 3 is disposed in the casting sand 15 outside the pattern 11. A front surface and a back surface of the blade portion 3 face each other in the vertical direction.

Figure 5:
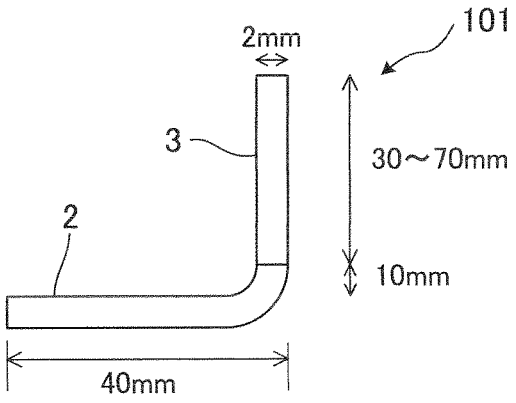
FIG. 5 is a side view of the buoyancy transfer jig.
Figure 6:
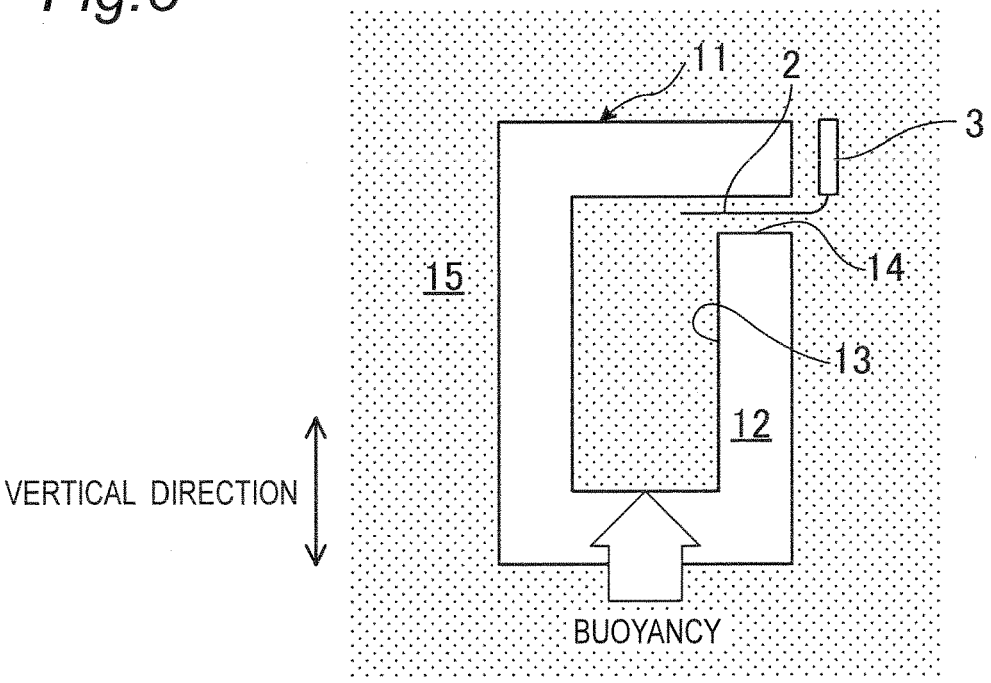
FIG. 6 is a cross-sectional side view of the pattern.

As shown in FIG. 5 which is a side view, a buoyancy transfer jig 101 may be formed such that a rod portion 2 and a blade portion 3 are orthogonal to each other. A length of the rod portion 2 in the axial direction is set to 40 mm, for example. However, the length of the rod portion 2 is not limited to such a length. A size of the blade portion 3 is set to 30 to 70 (mm)×10 (mm)×2 (mm), for example. However, the size of the blade portion 3 is not limited to such a size. The rod portion 2 of the buoyancy transfer jig 101 is, as shown in FIG. 6 which is a cross-sectional side view of the pattern, inserted in the opening portion 14 before the self hardening sand is completely hardened. At this stage of operation, the blade portion 3 is disposed in the casting sand 15 outside the pattern 11. A front surface and a back surface of the blade portion 3 face each other in the horizontal direction.

In the lost foam casting method, a pressure is reduced by sucking air downward in the vertical direction. Accordingly, as described later, in receiving buoyancy transferred to the blade portion 3 by the casting sand 15, the configuration where the front surface and the back surface of the blade portion 3 face each other in the vertical direction allows the casting sand 15 to constrain the blade portion 3 more easily.

(Strength of Refractory Coating)

Based on Archimedes' principle, buoyancy F which acts on the hollow portion 13 can be obtained by the following formula (1).

$$F=V(\rho m-\rho s) \quad \text{formula (1)}$$

Symbol "V" indicates a volume of the hollow portion 13, symbol "ρs" indicates bulk density of sand filled in the hollow portion 13, and symbol "ρm" indicates density of molten metal.

Assume that a refractory coating in the opening portion 14 which supports the hollow portion 13 forms a beam having a moment of inertia of area: I, a plate thickness in a vertical direction: h, and a length: L. Based on the theory of beam, to obtain a maximum stress σmax of a cantilever having an end portion on which buoyancy F acts, the maximum stress σmax is approximately calculated by the following formula (2). The calculation is made on the premise that sand in the opening portion 14 does not bear the load.

$$\sigma max=M/I\times t/2=hFL/2I=hV(\rho m-\rho s)L/2I \quad \text{formula (2)}$$

Assume a coating strength (hot strength) when a refractory coating has a highest temperature at the time of pouring as "σb". When the following formula (3) is established, the refractory coating on the opening portion 14 is not damaged, that is, "floating" where sand filled in the hollow portion 13 floats can be prevented.

$$\sigma b>\sigma max \quad \text{formula (3)}$$

In actually producing a cast product by casting, the sand filled in the opening portion 14 acquires a large strength as a continuous body due to hardening of sand generated by adding a resin to the sand or due to a stone wall effect obtained by firmly stacking the sand like a stone wall. In such a case, a stress applied to the refractory coating in the opening portion 14 is reduced by an amount corresponding to a drag α against buoyancy generated by the sand filled in the opening portion 14. Accordingly, the formula (3) can be expressed as a formula (4).

$$\sigma b>\sigma max-\alpha \quad \text{formula (4)}$$

However, it is difficult to densely fill sand in an upper portion of the opening portion 14 which extends in the horizontal direction. Accordingly, even when an attempt is made so as to increase density of the sand filled in the opening portion 14 by applying circular vibrations or reducing a pressure, it is difficult to obtain a large drag by the sand filled in the opening portion 14. In view of the above, it is often the case where the selection of a refractory coating having hot strength σb which satisfies the formula (3) is required.

However, even when the restriction is imposed on a mounting position of the opening portion 14 and a cross-sectional shape of the opening portion 14 and the refractory coating has a limited performance so that the formula (3) is not satisfied, it is possible to prevent "floating" with the use of the buoyancy transfer jig 1, 101. That is, in this embodiment, instead of generating a resistance against floating by using merely sand filled in the opening portion 14 in the form of a continuous body, the deformation of the whole opening portion 14 is suppressed using the buoyancy transfer jig 1, 101. In this embodiment, self hardening sand (for example, furan self hardening sand) is filled in the hollow portion 13 and the opening portion 14. This is because buoyancy which is transferred to the rod portion 2 from sand in the hollow portion 13 and is then transferred to the blade portion 3 is received by the casting sand 15 disposed outside the pattern 11 so as to allow the opening portion 14 to generate a reaction force (resistance force) which resists against buoyancy.

By disposing the rod portion 2 in the self hardening sand filled in the hollow portion 13 and the opening portion 14, buoyancy which acts on sand in the hollow portion 13 is transferred to the rod portion 2. Further, the blade portion 3 which is formed continuously with the rod portion 2 is disposed in the casting sand 15 disposed outside the pattern 11 and hence, the buoyancy transferred to the blade portion 3 from the rod portion 2 is received by the casting sand 15 disposed outside the pattern 11. With such an operation, a reaction force (resistance force) which resists against buoyancy can be generated in the self hardening sand filled in the opening portion 14. Accordingly, it is possible to suppress floating of sand filled in the foamed mold 12 and hence, the deformation of the self hardening sand filled in the opening portion 14 can be suppressed. As a result, it is possible to prevent the refractory coating applied to the opening portion 14 by coating from being damaged.

In this embodiment, as described previously, buoyancy transferred to the rod portion 2 is received by the casting sand 15 disposed outside the pattern 11 through the blade portion 3. Accordingly, when an area of the rod portion 2 and an area of the blade portion 3 which are brought into contact with the casting sand 15 outside the pattern 11 are small, the casting sand 15 cannot sufficiently receive the buoyancy so that sand in the hollow portion 13 moves.

Assume a drag generated by sand in the opening portion 14 as N1, and a deformation resistance of a refractory coating as N2. When buoyancy F which acts on the sand in the hollow portion 13 satisfies the following formula (5), the movement of the buoyancy transfer jig 1, 101 is suppressed.

$$N1+N2\geq F \quad \text{formula (5)}$$

Assuming that N2 is sufficiently smaller than N1, the formula (5) can be expressed as a formula (6).

$$N1\approx f(A)\geq F \quad \text{formula (6)}$$

N1 has high correlation with a frictional force between sand and the buoyancy transfer jig 1, 101 and with a sand pressure (both the frictional force and the sand pressure being proportional to a contact area). Accordingly, N1 can be expressed as a function of a contact area A of the buoyancy transfer jig 1, 101 with casting sand 15 disposed outside the pattern 11. Based on experimental results described later, the formula (6) can be expressed as a formula (7).

$$A\geq 7\times 10^{1}F \quad \text{formula (7)}$$

By setting the contact area A of the buoyancy transfer jig 1, 101 with the casting sand 15 disposed outside the pattern 11 to a value which satisfies the above formula (7), a reaction force (resistance force) which favorably resists against buoyancy can be generated in the self hardening sand filled in the opening portion 14.

Provided that the contact area A satisfies the above formula (7), a shape of the blade portion 3 is not limited to a plate shape, and may be a rod shape, a spherical shape, a circular columnar shape or an angular columnar shape.

Figure 7:
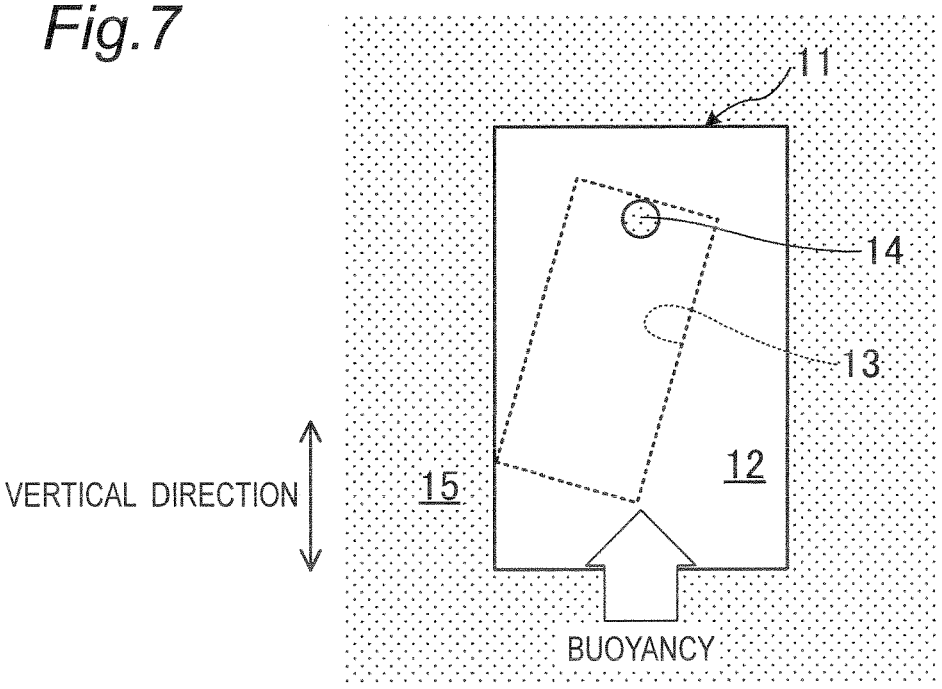
FIG. 7 is a side view of FIG. 1 as viewed in the direction A.

When the rod portion 2 has a circular cross-sectional shape, as shown in FIG. 7 which is a side view of FIG. 1 as viewed in the direction A, there may be a case where self hardening sand filled in the hollow portion 13 is rotated using the opening portion 14 as an axis. When the self hardening sand is rotated, the sand filled in the opening portion 14 is rotated about the rod portion 2. However, by forming the rod portion 2 to have a rectangular cross-sectional shape, the rotation of the sand filled in the opening portion 14 about the rod portion 2 can be suppressed due to contact resistance of the sand against corner portions of the rod portion 2 having a rectangular cross-sectional shape. Accordingly, it is possible to suppress that self hardening sand filled in the hollow portion 13 is rotated using the opening portion 14 as an axis.

By setting a length of one side of a cross section of the rod portion 2 larger than 3 mm, the rotation of the sand filled in the opening portion 14 about the rod portion 2 can be further suppressed. Accordingly, it is possible to further suppress that the self hardening sand filled in the hollow portion 13 is rotated using the opening portion 14 as an axis.

(Floating Evaluation)

Next, the presence or non-presence of "floating" was evaluated by changing the shape of the buoyancy transfer jig 1, 101. The evaluation was performed such that gray cast iron (JIS-FC250) having density ρm of $7.1\times10^{-6}$ kg/mm$^3$ was used, and self hardening sand having bulk density ρs of $1.4\times10^{-6}$ kg/mm$^3$ was filled in the hollow portion 13. The results are shown in Table 1. The buoyancy transfer jig with the description of "bent" in a column of shape of blade portion means the buoyancy transfer jig 101 shown in FIG. 5 where the rod portion 2 and the blade portion 3 are orthogonal to each other. The buoyancy transfer jig with no description of "bent" in the column of shape of blade portion means the buoyancy transfer jig 1 shown in FIG. 3.

TABLE 1

| No. | Cross-sectional shape of rod portion (mm) | Shape of blade portion (mm) | A/F | Presence or non-presence of floating |
|---|---|---|---|---|
| 1 | 5 × 5 | 10 × 30 | 43 | Δ |
| 2 | 5 × 5 | 10 × 50 | 71 | ○ |
| 3 | 5 × 5 | 10 × 70 | 100 | ○ |
| 4 | 5 × 5 | 10 × 30 (Bent) | 43 | Δ |
| 5 | 5 × 5 | 10 × 50 (Bent) | 71 | ○ |
| 6 | 5 × 5 | 10 × 70 (Bent) | 100 | ○ |
| 7 | φ5 | 10 × 30 (Bent) | 43 | Δ |
| 8 | φ5 | 10 × 50 (Bent) | 71 | Δ |
| 9 | φ5 | 10 × 70 (Bent) | 100 | Δ |
| 10 | 3 × 3 | 10 × 30 (Bent) | 43 | Δ |
| 11 | 3 × 3 | 10 × 50 (Bent) | 71 | Δ |

As a result of evaluation, it is understood that "floating" can be suppressed with the use of the buoyancy transfer jig 1, 101. An evaluation result "Δ" is given to the buoyancy transfer jig where sand in the hollow portion 13 was rotated or the like using the opening portion 14 as an axis. For example, with respect to the buoyancy transfer jigs where a length of the blade portion 3 is set to 50 mm or more, the buoyancy transfer jig where a rod portion has a circular cross-sectional shape with a diameter of 5 mm and the buoyancy transfer jig where a rod portion has a rectangular cross-sectional shape with a size of one side of 5 mm are compared with each other. As a result of comparison, in the former buoyancy transfer jig, the hollow portion 13 was inclined or the like. On the other hand, in the latter buoyancy transfer jig, the deformation of the hollow portion 13 was completely suppressed. Based on such a result, it is understood that the rod portion 2 preferably has a rectangular cross-sectional shape. It is also understood that a length of one side of a cross section of the rod portion 2 is preferably larger than 3 mm.

Figure 8:
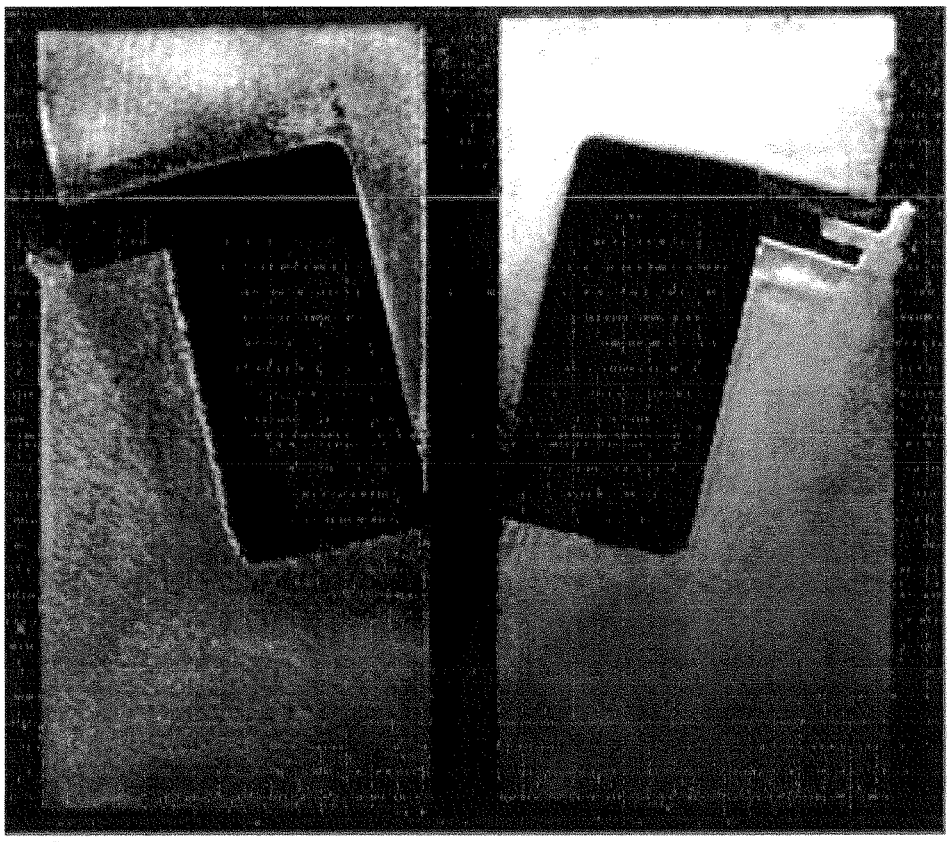
FIG. 8 is a cross-sectional view of the pattern.

When a length of the blade portion 3 was set to 30 mm or less, as shown in FIG. 8 which is a cross-sectional view of the pattern, the hollow portion 13 was inclined so that it is understood that the deformation of the hollow portion 13 cannot be completely suppressed. This is because the buoyancy transfer jig 1, 101 was not sufficiently held by the casting sand 15 disposed outside the pattern 11. In view of the above, it is necessary to increase a contact area of the buoyancy transfer jig 1, 101 with the casting sand 15 disposed outside the pattern 11.

By putting density of gray cast iron and bulk density of self hardening sand into the formula (1), the following calculation result was obtained.

$$\begin{aligned} F &= V(\rho m - \rho s) \\ &= 50\times50\times100\times(7.1-1.4) \\ &= 1.4\ kgf \\ &= 14N \end{aligned}$$

Assume a drag generated by the sand in the opening portion 14 as N1, and a deformation resistance of the refractory coating as N2. When buoyancy F which acts on the hollow portion 13 satisfies the following formula (5), the movement of the buoyancy transfer jig 1, 101 is suppressed by the casting sand 15 disposed outside the pattern 11.

$$N1+N2\geq F \qquad \text{formula (5)}$$

Assuming that N2 is sufficiently smaller than N1, the formula (5) can be expressed as the formula (6).

$$N1\approx f(A)\geq F \qquad \text{formula (6)}$$

Figure 9:
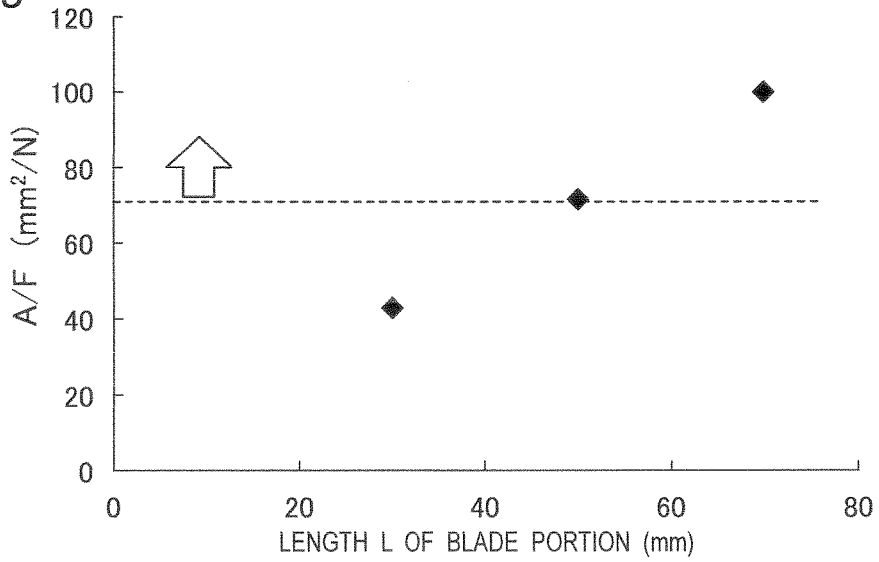
FIG. 9 is a graph showing a relationship between a length L of a blade portion and A/F.
Figure 10:
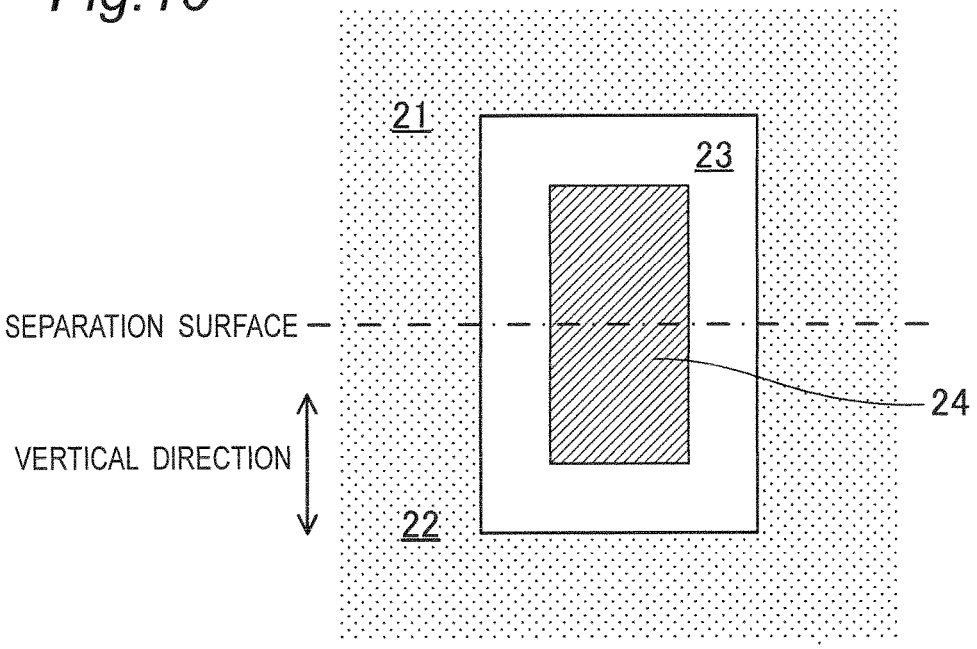
FIG. 10 is a cross-sectional side view in a cavity casting method.
Figure 11:
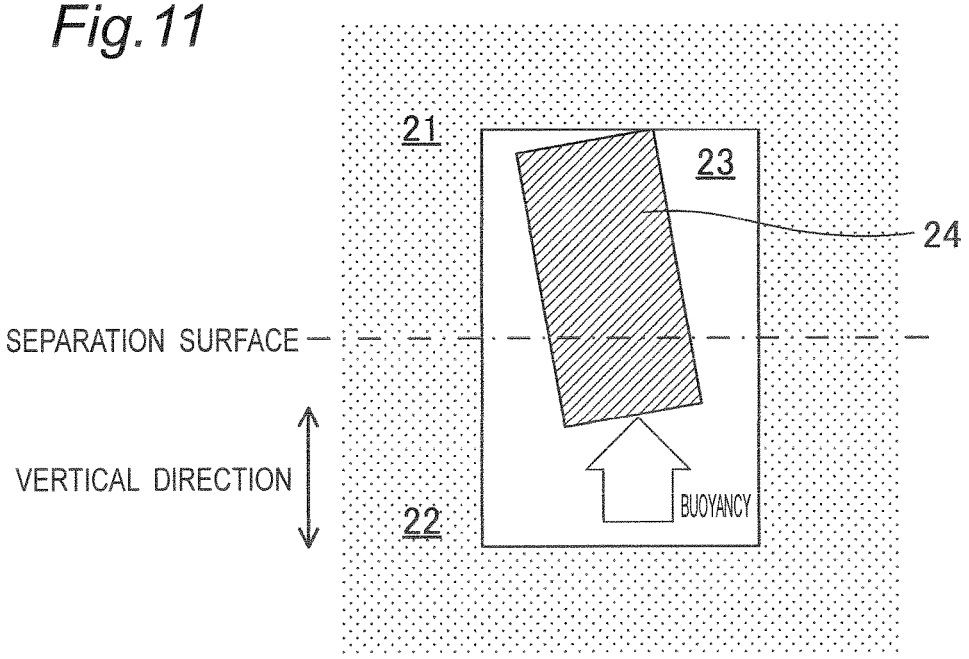
FIG. 11 is a cross-sectional side view in the cavity casting method.
Figure 12:
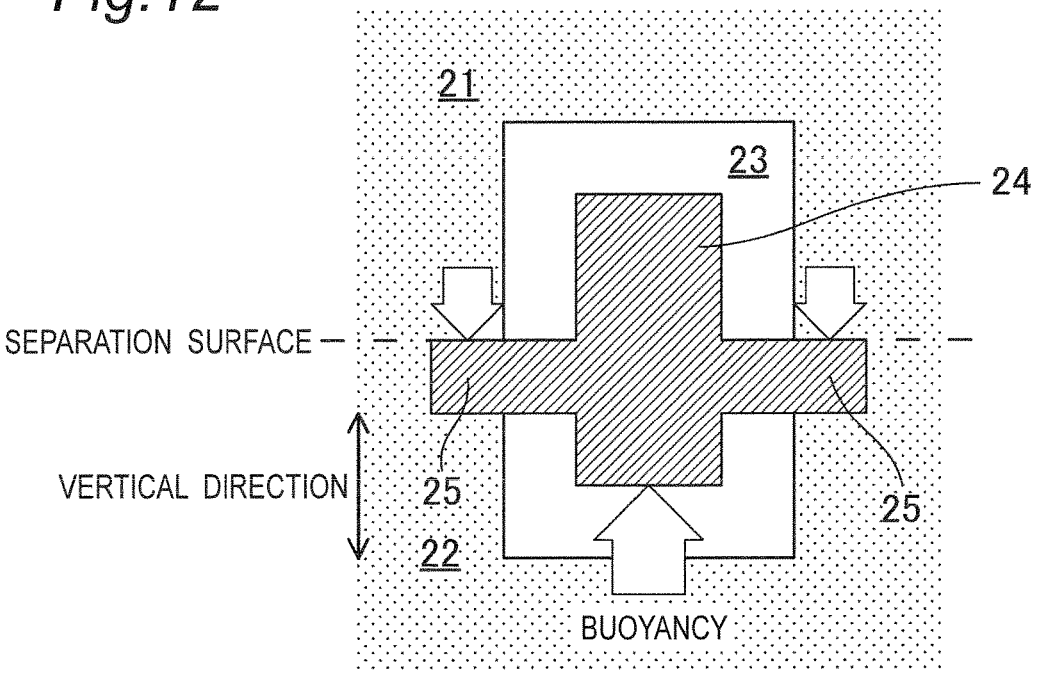
FIG. 12 is a cross-sectional side view in the cavity casting method.
Figure 13:
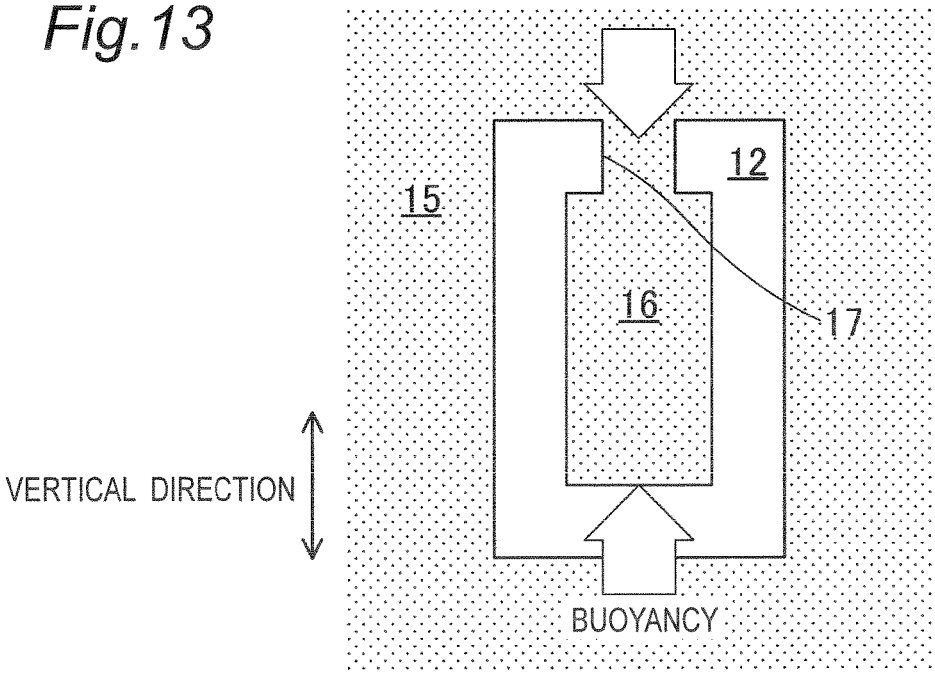
FIG. 13 is a cross-sectional side view in a lost foam casting method.

N1 has high correlation with a frictional force between sand and the buoyancy transfer jig 1, 101 and with a sand pressure (both the frictional force and the sand pressure being proportional to the contact area). Accordingly, N1 can be expressed as a function of the contact area A of the buoyancy transfer jig 1, 101 with the casting sand 15 disposed outside the pattern 11. Out of the results shown in Table 1, with respect to an angular rod where the rod portion 2 has a cross section of 5×5 mm, the relationship between a length L of the blade portion 3 and A/F is shown in FIG. 9. It is understood from FIG. 9 that the formula (6) can be expressed as a formula (7).

$$A\geq7\times10^{1}F \qquad \text{formula (7)}$$

Accordingly, it is understood that by setting the contact area A of the buoyancy transfer jig 1, 101 with the casting sand 15 disposed outside the pattern 11 to a value which satisfies the above formula (7), a favorable reaction force (resistance force) which resists against buoyancy can be generated in the self hardening sand filled in the opening portion 14.

EXAMPLE

Next, gray cast iron (JIS-FC250) was melted to produce molten iron. A pattern was prepared by forming a rectangular parallelepiped hollow portion in the inside of a rectangular parallelepiped foamed mold and by disposing an opening portion having a diameter of 16 mm and a length of 25 mm in a horizontal direction (θ=90°). Then, a cast product was produced by filling molten iron into the pattern. In this example, the foamed mold had a width a of 100 mm, a depth b of 100 mm, and a height c of 200 mm. The hollow portion had a width d of 50 mm, a depth e of 50 mm, and a height f of 100 mm. Density ρm of the gray cast iron was $7.1\times10^{-6}$ kg/mm$^3$.

"furan self hardening sand" was filled in the hollow portion. "furan self hardening sand" is a mixed material of sand, a resin, and a hardening agent. Sand used for producing self hardening sand is silica sand (containing $SiO_2$ as a main component). A resin used in self hardening sand as an adhesive agent was an acid setting furan resin containing furfuryl alcohol, and an addition amount of the acid setting furan resin for sand was 0.8%. A hardening agent used in self hardening sand as a hardening catalyst was a furan resin hardening agent produced by mixing xylenesulfonic acid-based hardening agent and a sulfuric-acid-based hardening agent. An addition amount of the hardening agent for a furan resin was 40%. Bulk density ρs of the self hardening sand was $1.4\times10^{-6}$ kg/mm$^3$.

By filling density of gray cast iron and bulk density of self hardening sand into the formula (1), the following calculation result was obtained.

$$\begin{aligned} F &= V(\rho m - \rho s) \\ &= 50\times50\times100\times(7.1-1.4) \\ &= 1.4\ kgf \\ &= 14N \end{aligned}$$

In this example, a refractory coating whose hot strength σb is unknown was coated twice, and an average thickness of a coating layer was set to 0.8 mm. Characteristics of the refractory coating at a room temperature are shown in Table 2.

TABLE 2

| Refractory coating | Bulk density ρc (g/cm$^3$) | Room-temperature flexural strength TSc' (MPa) | Aggregate particle size (×100 μm) |
|---|---|---|---|
| Commercially available product for EPC | 2.8-3.0 | >4.4 | 0.9 |

By selecting the buoyancy transfer jig 1, 101 formed of: a rod portion formed using an angular rod having a cross-sectional area of 5×5 mm; and a blade portion which is formed with the rod portion and has a plate thickness of 2 mm, a length of 70 mm, and a width of 10 mm, the buoyancy transfer jigs which satisfy the formula (7) were obtained. In this case, the contact area A of the buoyancy transfer jig with the sand was 121 mm$^2$. By inserting the rod portion of the buoyancy transfer jig 1, 101 into the hollow portion from the opening portion, cast products having a favorable finished state were obtained without causing "floating".

Advantageous Effect

As has been described heretofore, according to the buoyancy transfer jig 1, 101 of this embodiment, by disposing the rod portion 2 in the self hardening sand filled in the hollow portion 13 and the opening portion 14, buoyancy which acts on the sand in the hollow portion 13 is transferred to the rod portion 2. Further, by disposing the blade portion 3 which is formed continuously with the rod portion 2 in the casting sand 15 disposed outside the pattern 11, the buoyancy transferred to the blade portion 3 from the rod portion 2 is received by the casting sand 15 disposed outside the pattern 11. With such an operation, a reaction force (resistance force) which resists against buoyancy can be generated in the self hardening sand filled in the opening portion 14. Accordingly, it is possible to suppress floating of self hardening sand filled in the inside of the foamed mold 12 and hence, deformation of self hardening sand filled in the opening portion 14 can be suppressed. As a result, it is possible to prevent the refractory coating applied to the opening portion 14 by coating from being damaged and hence, it is possible to produce by casting a cast product having a favorable finished state.

By setting the contact area A of the buoyancy transfer jig 1, 101 with the casting sand 15 disposed outside the pattern 11 to a value which satisfies the above formula (7), a favorable reaction force (resistance force) which favorably resists against buoyancy can be generated in the self hardening sand filled in the opening portion 14. With such setting of the contact area A, it is possible to preferably suppress floating of self hardening sand filled in the inside of the foamed mold 12.

When the rod portion 2 has a circular cross-sectional shape, there may be a case where self hardening sand filled in the hollow portion 13 is rotated using the opening portion 14 as an axis. When the self hardening sand is rotated, the sand filled in the opening portion 14 is rotated about the rod portion 2. However, by forming the rod portion 2 to have a rectangular cross-sectional shape, the rotation of the sand filled in the opening portion 14 about the rod portion 2 can be suppressed due to contact resistance of the sand against corner portions of the rod portion 2 having a rectangular cross-sectional shape. Accordingly, it is possible to suppress that self hardening sand filled in the hollow portion 13 is rotated using the opening portion 14 as an axis.

By setting a length of one side of a cross section of the rod portion 2 larger than 3 mm, the rotation of the sand filled in the opening portion 14 about the rod portion 2 can be further suppressed. Accordingly, it is possible to further suppress that the self hardening sand filled in the hollow portion 13 is rotated using the opening portion 14 as an axis.

Although the embodiment of the present invention has been described heretofore, the embodiment is merely a specific example. Particularly, the embodiment does not limit the present invention, and a specific configuration and the like of the embodiment can be changed in design as desired. Further, the manner of operation and advantageous effects described in the embodiment of the present invention are the enumeration of the most preferable manner of operation and advantageous effects acquired by the present invention, and the manner of operation and advantageous effects of the present invention are not limited to the manner of operation and advantageous effects described in the embodiment of the present invention.

The invention claimed is:

1. A sand mold comprising; a buoyancy transfer jig used in a lost foam casting method for casting a cast product where a pattern is prepared by applying a refractory coating by coating to a surface of a foamed mold having a hollow portion in the inside thereof, the pattern is embedded into casting sand and, thereafter, molten metal is poured into the inside of the pattern, and the foamed mold is replaced with the molten metal by burning out the foamed mold, the buoyancy transfer jig comprising:

a rod-shaped rod portion which is disposed extending from an outside of the pattern to an inside of the hollow portion by way of an opening portion which is formed in the foamed mold and makes the outside of the pattern and the hollow portion connected with each other, and is disposed in self hardening sand filled in the hollow portion and the opening portion; and a plate-shaped blade portion which is formed continuously with the rod portion and is disposed in the casting sand.

2. The sand mold according to claim 1, wherein a contact area A of the buoyancy transfer jig with the casting sand disposed outside the pattern satisfies a following formula with respect to buoyancy F which acts on the self hardening sand in the hollow portion $$A \geq 7 \times 10^{1} F.$$

3. The sand mold according to claim 1, wherein the rod portion has a rectangular cross-sectional shape.

4. The sand mold according to claim 3, wherein a length of one side of a cross section of the rod portion is more than 3 mm.

* * * * *